US009666318B2

(12) United States Patent
Scaglione et al.

(10) Patent No.: US 9,666,318 B2
(45) Date of Patent: May 30, 2017

(54) STORAGE, TRANSPORTATION AND DISPOSAL SYSTEM FOR USED NUCLEAR FUEL ASSEMBLIES

(71) Applicant: UT-Battelle, LLC, Oak Ridge, TN (US)

(72) Inventors: John M. Scaglione, Knoxville, TN (US); John C. Wagner, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 15/363,641

(22) Filed: Nov. 29, 2016

(65) Prior Publication Data

US 2017/0076827 A1 Mar. 16, 2017

Related U.S. Application Data

(62) Division of application No. 13/554,111, filed on Jul. 20, 2012, now Pat. No. 9,543,048.

(Continued)

(51) Int. Cl.
*G21F 5/012* (2006.01)
*G21F 5/06* (2006.01)

(Continued)

(52) U.S. Cl.
CPC ..... *G21F 5/012* (2013.01); *G21F 5/008* (2013.01); *G21F 5/06* (2013.01); *G21F 5/14* (2013.01); *G21Y 2004/40* (2013.01)

(58) Field of Classification Search
CPC ... G21C 19/00; G21F 5/06; G21F 5/08; G21F 5/12

(Continued)

(56) References Cited

U.S. PATENT DOCUMENTS 4,781,883 A 11/1988 Daugherty et al.
4,930,650 A 6/1990 Wells (Continued)

OTHER PUBLICATIONS

Raiko, H., Sandstrom, R., Ryden, J., and Johansson, M., "Design Analysis Report for the Canister," TR-10-28, Svensk Karnbransiehantering AB, Apr. 2010.

(Continued)

*Primary Examiner* — Jack W Keith
*Assistant Examiner* — Lily C Garner
(74) *Attorney, Agent, or Firm* — Warner Norcross & Judd LLP

(57) ABSTRACT

An integrated storage, transportation and disposal system for used fuel assemblies is provided. The system includes a plurality of sealed canisters and a cask sized to receive the sealed canisters in side by side relationship. The plurality of sealed canisters include an internal basket structure to receive a plurality of used fuel assemblies. The internal basket structure includes a plurality of radiation-absorbing panels and a plurality of hemispherical ribs generally perpendicular to the canister sidewall. The sealed canisters are received within the cask for storage and transportation and are removed from the cask for disposal at a designated repository. The system of the present invention allows the handling of sealed canisters separately or collectively, while allowing storage and transportation of high burnup fuel and damaged fuel to the designated repository.

8 Claims, 11 Drawing Sheets

Related U.S. Application Data

(60) Provisional application No. 61/509,715, filed on Jul. 20, 2011.

(51) Int. Cl.
*G21F 5/008* (2006.01)
*G21F 5/14* (2006.01)

(58) Field of Classification Search
USPC ..... 376/272
See application file for complete search history.

(56) References Cited

U.S. PATENT DOCUMENTS

| | | | |
|---|---|---|---|
| 5,550,882 | A | 8/1996 | Lehnert et al. |
| 2003/0004390 | A1 | 1/2003 | Matsunaga et al. |
| 2009/0175404 | A1 | 7/2009 | Singh et al. |

OTHER PUBLICATIONS

U.S. Department of Energy, "Transportation, Aging, and Disposal Canister System Performance Specification," DOE/RW-0585, Office of Civilian Radioactive Waste Management System, Mar. 2008.

Gregg, D.W., O'Neal, W.C., Initial Specifications for Nuclear Waste Package External Dimensions and Materials, UCID-19926, Lawrence Livermore National Laboratory, 1983.

Bridges, T.L., Lengyel, A.L., Morton, D.K. and Pincock, D.L., "Standardized DOE Spent Nuclear Fuel Canister and Transportatoin System for Shipment tot he National Repository," Idaho National Engineering and Environmental Laboratory, Feb. 2001.

International Search Report and Written Opinion for PCT Application No. PCT/US2012/047561 mailed Dec. 20, 2012.

Kim, Soon Sam, Chad Pope, and Larry L. Taylor. "Criticality Analysis for Proposed Maximum Fuel Loading in a Standardized SNF Canister with Type 1a Baskets." (2007).

STORAGE, TRANSPORTATION AND DISPOSAL SYSTEM FOR USED NUCLEAR FUEL ASSEMBLIES

CROSS-REFERENCE TO RELATED APPLICATIONS

This application claims the benefit of U.S. Provisional Application No. 61/509,715, filed Jul. 20, 2011, the disclosure of which is hereby incorporated by reference in its entirety.

STATEMENT REGARDING FEDERALLY SPONSORED RESEARCH AND DEVELOPMENT

This application is a divisional of prior application Ser. No. 13/554,111, filed Jul. 20, 2012, which claims the benefit of U.S. Provisional Application No. 61/509,715, filed Jul. 20, 2011, the disclosure of which is hereby incorporated by reference in its entirety.

BACKGROUND OF THE INVENTION

The present invention relates to systems for the storage, transportation and disposal of used nuclear fuel assemblies.

Used fuel assemblies are a primary byproduct of power-generating nuclear processes, and must generally be stored or disposed of in a manner that limits any impact on the surrounding environment. Temporary storage solutions include the fixation of used fuel assemblies in dry casks, termed dry cask storage. Long term disposal is in many ways preferable to dry cask storage, however, and a number of repository concepts are actively being considered. Many existing dry casks do not satisfy the expected package size limitations for the direct disposal of used nuclear fuel assemblies at the proposed repositories. As a result, used nuclear fuel assemblies may require repackaging into more suitable containers for transportation and/or disposal. However, repackaging used nuclear fuel assemblies creates tremendous radiological, operational and financial liabilities, particularly following an extended storage period.

Currently, storage and transportation are considered separately from disposal under relevant U.S. regulations. For example, the used nuclear fuel management system operates under multiple regulations, e.g., 10 CFR 72 for storage, 10 CFR 50 and 72 for dry cask loading, 10 CFR 71 for transportation, and similar regulations to 10 CFR 60 and 63 for eventual disposal. Existing regulations for storage require the used nuclear fuel to be retrievable. Existing regulations for transportation do not explicitly require that fuel rods be intact or undamaged, and relevant provisions allow for specially designed canisters to move damaged fuel. Transportation regulations currently limit fuel to a maximum burnup of 45 GWd/MTU, primarily based on limited information available on the mechanical properties of high burnup cladding as well as the effects of long-term storage on high burnup (>45 GWd/MTU) fuel. Existing regulations for disposal are specific to the previously planned Yucca Mountain Repository, but are likely to be modified, perhaps substantially, to meet future repository site and geologic media performance objectives, perhaps depending on the geologic media, e.g., clay/shale, salt, or crystalline rock. Because the disposal requirements are currently open-ended and undefined, there is at present no domestic market for dry casks designed to support disposal operations. As a result, storage and transportation casks are being designed, licensed and loaded without regard for disposal operations and requirements.

SUMMARY OF THE INVENTION

An integrated storage, transportation and disposal system for used nuclear fuel assemblies is provided. The system includes a plurality of sealed canisters, each containing four or more used fuel assemblies, and a cask sized to receive the sealed canisters. The sealed canisters are inserted within the cask for storage and/or transportation, and the sealed canisters are removed from the cask for disposal at a designated repository. The system of the present invention allows the handling of sealed canisters separately or collectively, while allowing storage and transportation of high burnup fuel and damaged fuel.

In one embodiment, the sealed canisters include longitudinal reinforcing members and radiation-absorbing panels. The longitudinal reinforcing members surround the used fuel assemblies, while the radiation-absorbing panels are interposed between the used fuel assemblies. The longitudinal reinforcing members are generally positioned along the canister sidewall to stabilize the used fuel assemblies within the canister enclosure. The reinforcing members include a u-shaped cross-section and upper and lower hemispherical ribs extending radially within the canister enclosure. The radiation-absorbing panels include a chevron-shaped cross section and are interposed between adjacent used fuel assemblies along the length of the canister enclosure.

In another embodiment, the sealed canisters include a removable closure or lid for the extraction of used fuel assemblies. Each used fuel assembly is self-contained within a fuel basket tube, optionally sized for deep borehole disposal, and each fuel basket tube includes primary and secondary retrieval mechanisms. The retrieval mechanisms facilitate the removal of the fuel basket tubes from the canister, if desired, with added redundancy in instances where one retrieval mechanism is no longer viable.

In still another embodiment, the cask includes a base and a cylindrical sidewall defining an interval volume sized to receive a plurality of sealed canisters in side by side relationship. The cask includes a basket assembly nested within the cask enclosure and having a central region and a plurality of basket cells radially outward of the central region. The central region can accommodate damaged fuel cans or greater than class C (GTCC) waste, and the cylindrical sidewall can include a concrete overpack for upright storage of the cask. The cask—with the sealed canisters inside—can be loaded into a larger transport cask and shipped for direct disposal or reprocessing of the used fuel assemblies. Alternatively, the sealed canisters can be repackaged into an alternative transport cask for truck transportation, potentially eliminating the need for direct rail access. The cask can be reused in many instances, particularly where the cask is not used in disposal operations.

In various embodiments, the present invention provides a multi-canister system having superior assembly and burnup capacity over known systems while also minimizing the number of cask loadings required to manage a used nuclear fuel inventory. The multi-canister system can also enable a higher percentage of fuel to meet subcriticality requirements. The multi-canister system is adapted for a wide range of geologic media, including tuff, clay/shale, salt, and crystalline rock, and can reduce the life-cycle cost for used fuel storage, transport and disposal.

These and other features and advantages of the present invention will become apparent from the following description of the invention, when viewed in accordance with the accompanying drawings and appended claims.

DETAILED DESCRIPTION OF THE CURRENT EMBODIMENTS

The invention as contemplated and disclosed herein includes an integrated, multi-canister system to meet current and future requirements for storage, transportation and disposal of used nuclear fuel assemblies. As explained in greater detail below, the integrated system includes modular canisters received within a cask for storage and transportation and removable from a cask for disposal.

Figure 1:
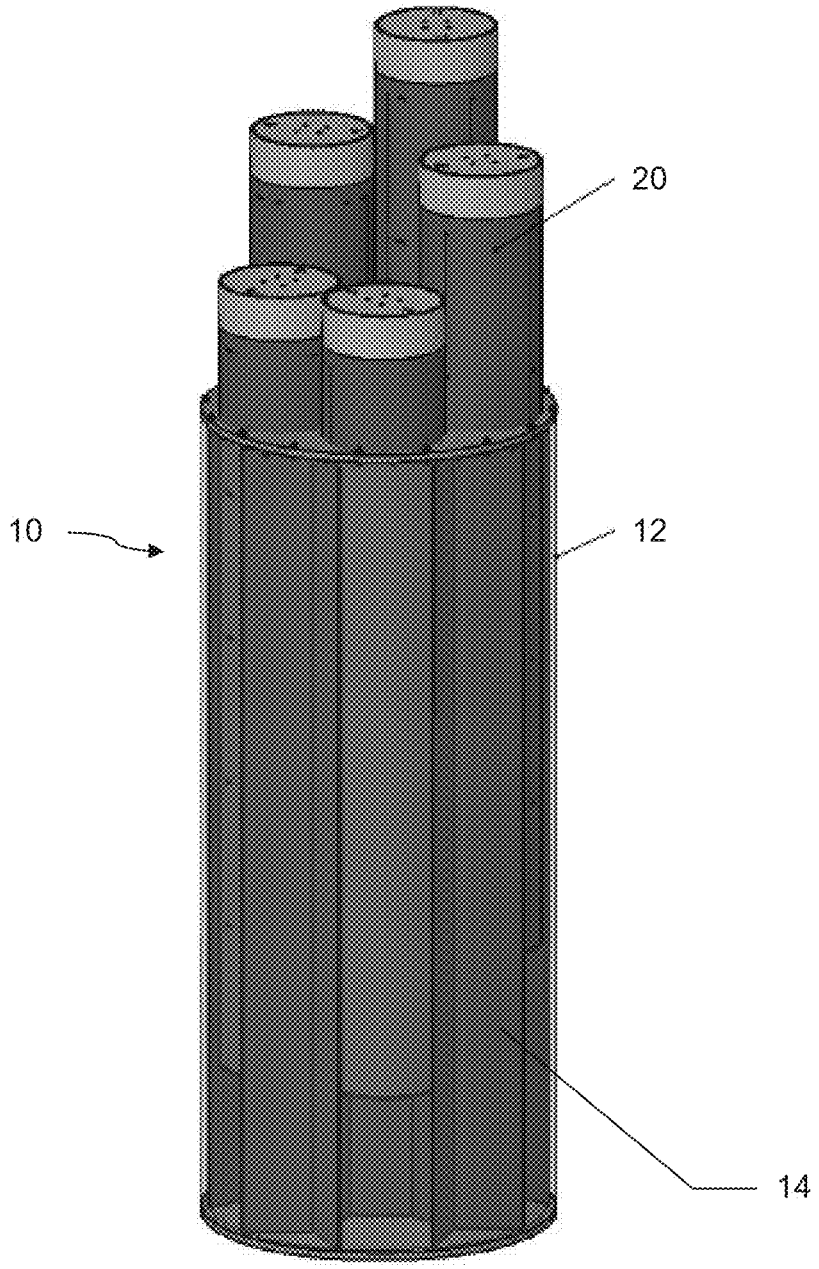
FIG. 1 is an illustration of a cask including multiple modular canisters in accordance with an embodiment of the invention.
Figure 2:
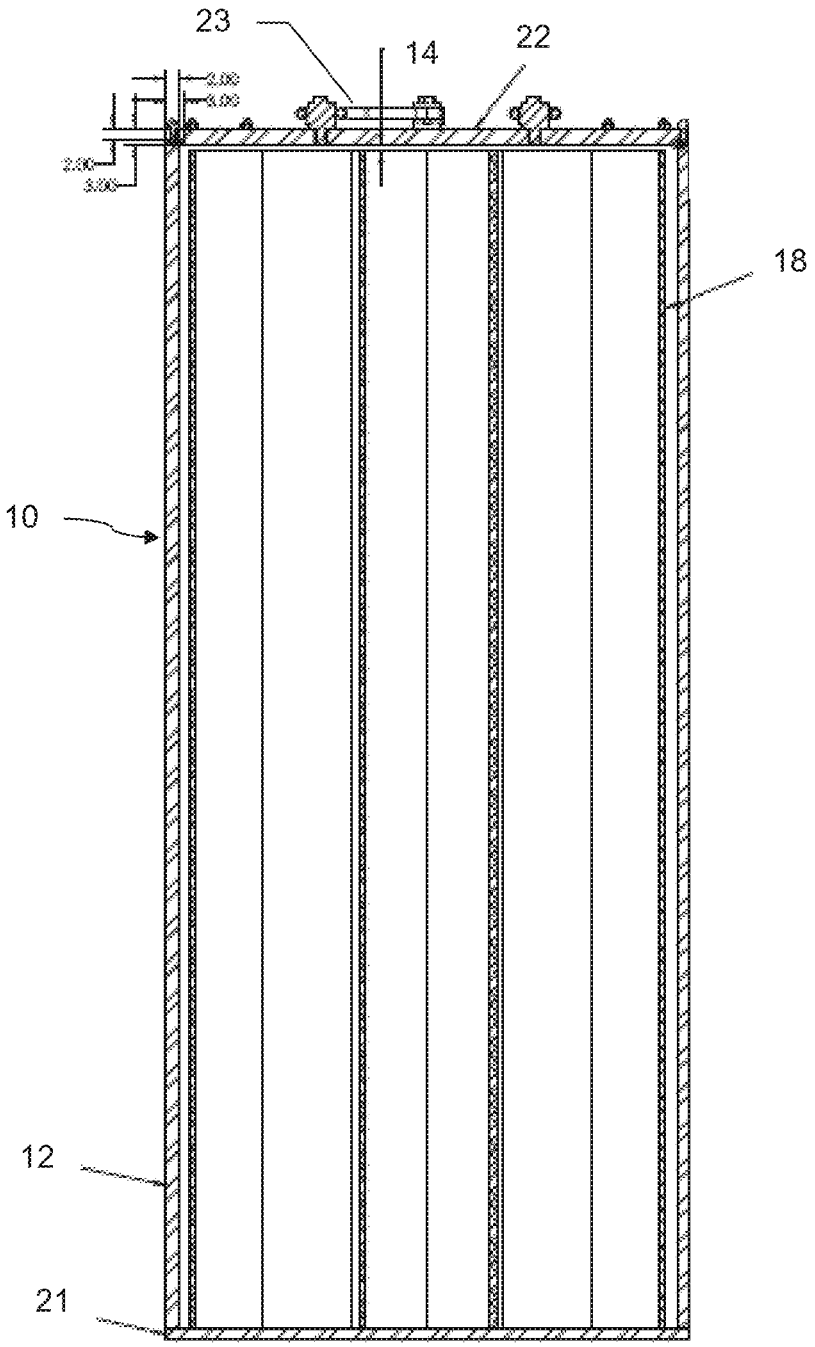
FIG. 2 is a cross-sectional side view of the cask of FIG. 1.
Figure 3:
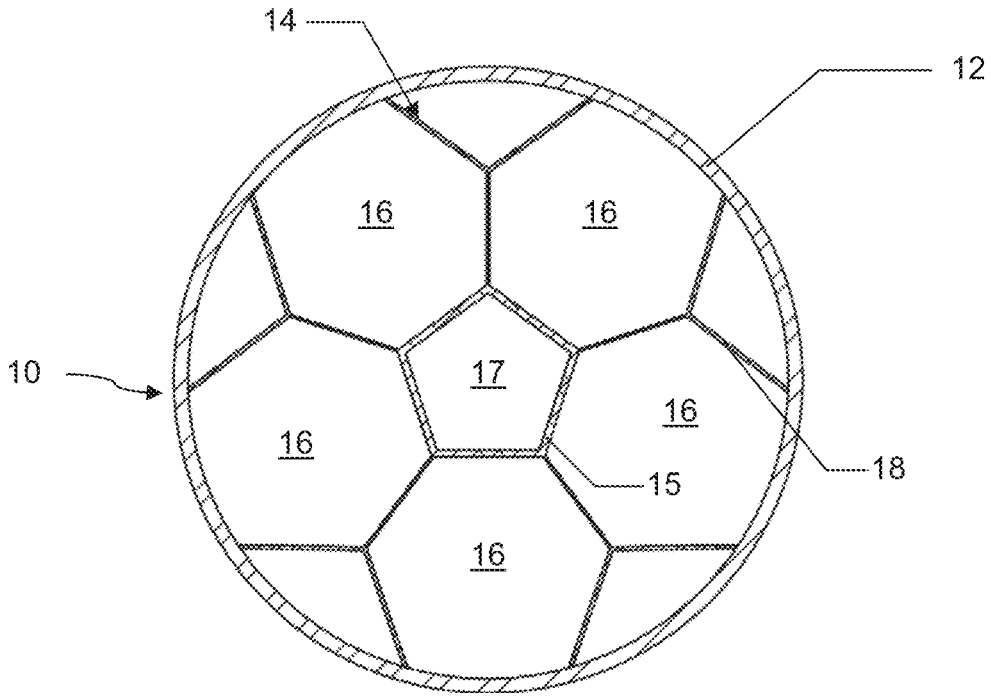
FIG. 3 is a cross-sectional top view of the cask of FIG. 1.

Referring now to FIGS. 1-3, a cask is illustrated and generally designated 10. The cask 10 includes cylindrical shell 12 defining an internal cask volume. The cylindrical shell 12 can optionally including a steel, cermet or concrete overpack. In use, the cask 10 is positionable in an upright storage configuration on a storage pad meeting applicable storage requirements for used nuclear fuel assemblies. The cask 10 can alternatively include horizontal storage or in-earth storage with suitable seismic constraints. As also shown in FIGS. 1-3, the cask 10 includes an internal basket assembly 14 including multiple canister basket cells 16 for receiving at least one canister 20. The basket assembly 14 can include multiple vertical reinforcing spars, optionally in a polygonal honeycomb configuration, and further optionally a pentagon, hexagon, heptagon, octagon or other configuration. As shown in FIG. 3, for example, the basket assembly 14 can include a central, pentagon-shaped sidewall 15 extending along the length of the cask 10. The pentagon-shaped sidewall 15 defines a central region 17 to accommodate damaged fuel cans or GTCC waste. Five y-shaped spars 18 extend axially along the length of the cask 10, and radially from the corners of the pentagon-shaped sidewall 15 toward the outer cylinder sidewall 12. The y-shaped spars 18, the pentagon sidewall 15, and the cylindrical sidewall 12 cooperate to define five basket cells 16 for five canisters 20, each basket cell 16 being disposed radially outward of a cask centerline. The basket assembly 14 is a monolithic structure in the present embodiment, optionally being removeable axially from the cask 10 but prohibited from rotating with respect to the cask 10. For example, the cask 10 can include a clip for each y-shaped spar 18 abutting the cylinder sidewall 12 to prevent rotation of the basket assembly 14 within the cask 10. The basket assembly 14 can be formed from steel in the present embodiment, but other materials may be used as desired. The basket assembly 14 can meet thermal requirements for the system, while the individual canisters 20 can meet structural and subcriticality requirements for storage, transportation, and disposal. The cask 10 can additionally include a base 21 and a lid 22 with hooks 23 for removal of the lid 22 from the canister sidewall 12 as shown in FIG. 2. The sealed canisters 20 are positionable within the cask 10, and more specifically, the canister basket cells 16, in side by side relationship. In addition, the cask 10 can be loaded into a larger transport cask and sent to direct disposal or reprocessing. Alternatively, the canisters 20 can be repackaged from the cask 10 into a special purpose transport cask for truck transport or rail transport.

Referring now to FIGS. 4-7, a canister 20 includes a base or end 24, a sidewall 26, and a lid 28 to cooperatively define an enclosure for containing a plurality of used nuclear fuel assemblies 30 therein. The canister 20 is cylindrically-shaped in the present embodiment, but can include other shapes or geometries in other embodiments. For example, the canister 20 can be box-shaped and can include a four-sided sidewall 26 if desired. Each fuel assembly 30 is self-contained within a fuel basket tube 32, and multiple fuel basket tubes 32 are received within the canister 20 in side by side relationship. In the illustrated embodiment, the canister sidewall 26 includes an inner diameter of about 68 cm and an outer diameter of about 78 cm, and the cask 10 includes an inner diameter of about 210 cm. These dimensions are exemplary, however, and the cask 10 and containers 20 can be larger or smaller than depicted herein.

Figure 4:
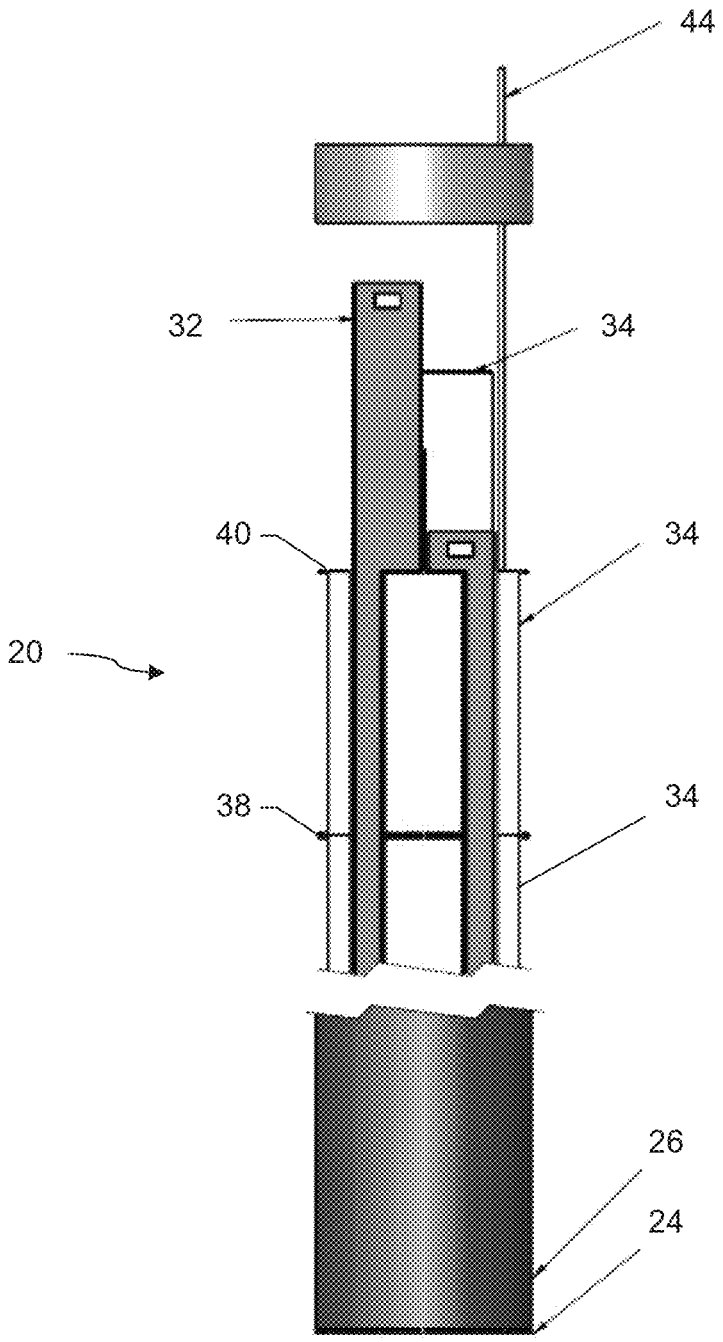
FIG. 4 is an illustration of a PWR canister in accordance with an embodiment of the invention.
Figure 5:
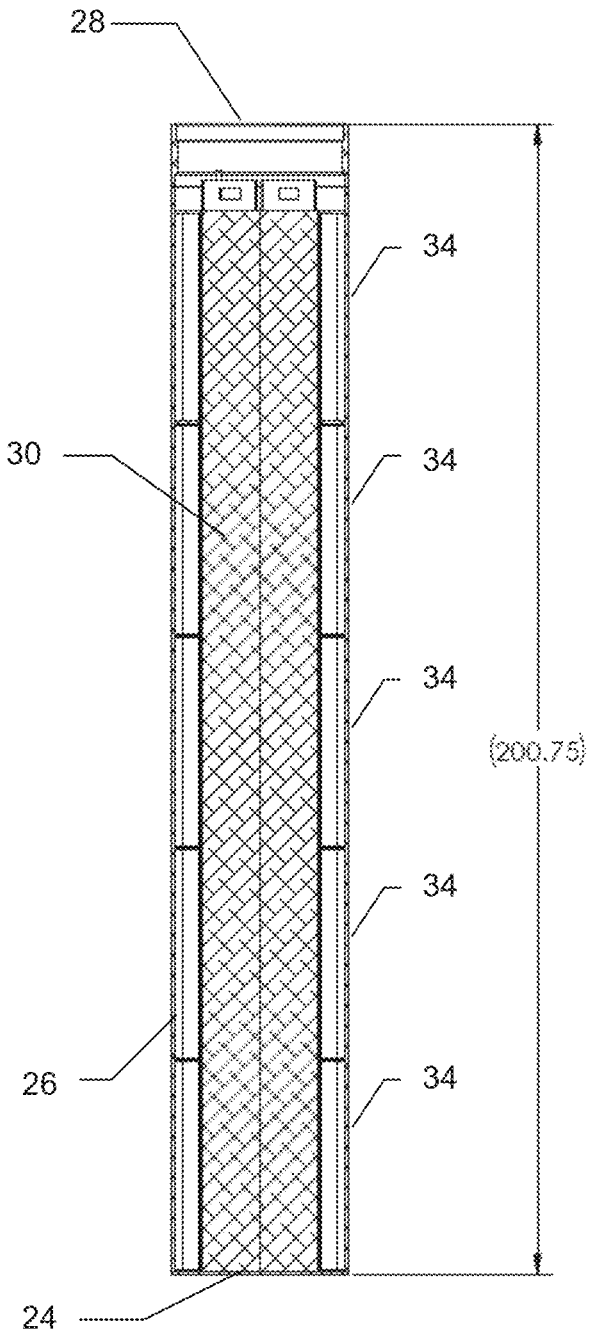
FIG. 5 is a cross-sectional side view of the canister of FIG. 4.

As also shown in FIGS. 4-7, the canister 20 includes multiple longitudinal reinforcing members 34 to stabilize the used fuel assemblies within the canister enclosure. In particular, the longitudinal reinforcing members 34 extend axially within the canister enclosure and outward of the canister centerline, being interposed between the fuel basket tubes 32 and the canister sidewall 26. Multiple longitudinal reinforcing members 34 are stacked atop one another as generally shown in FIGS. 4-5, collectively extending from the canister base 24 to the canister lid 28. For example, the canister 20 includes four columns of reinforcing members 34 in the present embodiment, with each column abutting two fuel basket tubes 32, such that the fuel basket tubes 23 are sandwiched between the reinforcing members 34 and are spaced apart from the canister sidewall 26. In other embodiments, however, a single longitudinal reinforcing member 34 will extend along the length of the canister 20. As perhaps best shown in FIG. 7, each reinforcing member 34 includes a u-shaped sidewall 36 that terminates in lower and upper hemispherical ribs 38, 40 that extend radially within the canister enclosure. The u-shaped sidewall 36 includes a major web 35 and two spaced-apart minor webs 37, 39 extending generally perpendicularly from the periphery of the major web 35. The lower and upper ribs 38, 40 are spaced apart from each other along the length of the reinforcing member 34 and add torsional rigidity to the reinforcing member 34, while also functioning as a heat conduit from the fuel basket tubes 32 to the canister sidewall 26. Collectively, the reinforcing members 34 and the fuel basket tubes 32 provide structural support to maintain the used nuclear fuel assemblies 30 in a predetermined orientation within each canister 20.

Figure 6:
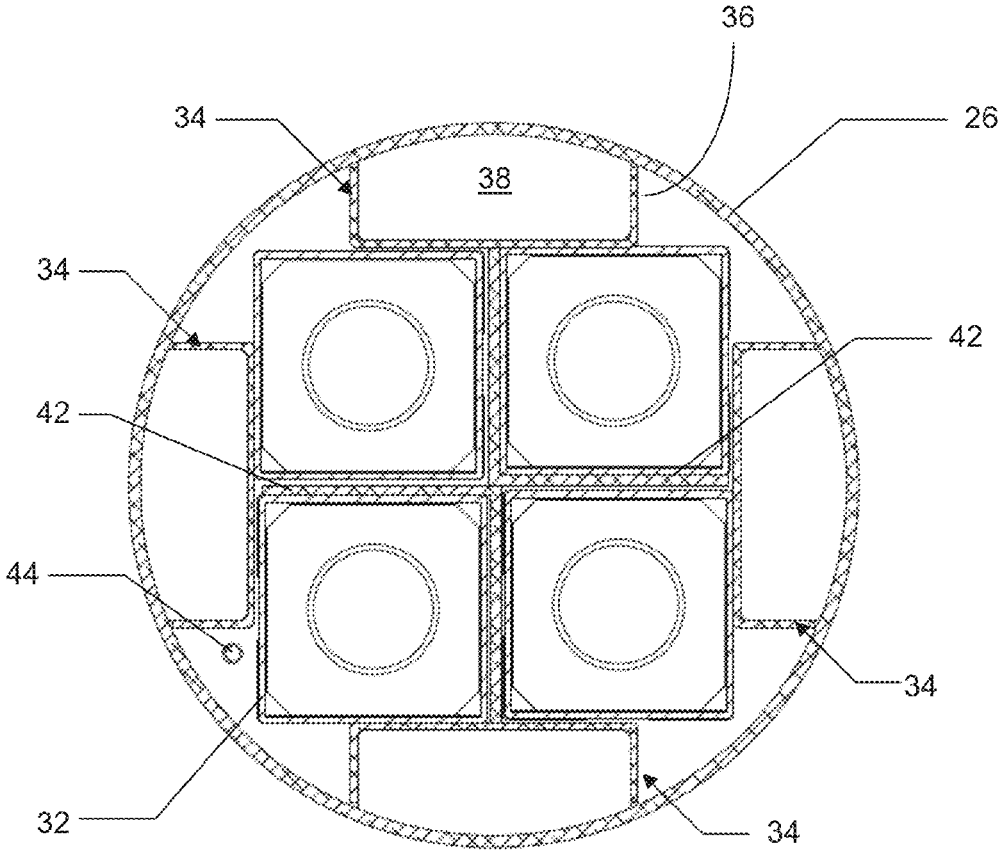
FIG. 6 is a cross-sectional top view of the canister of FIG. 4.
Figure 7:
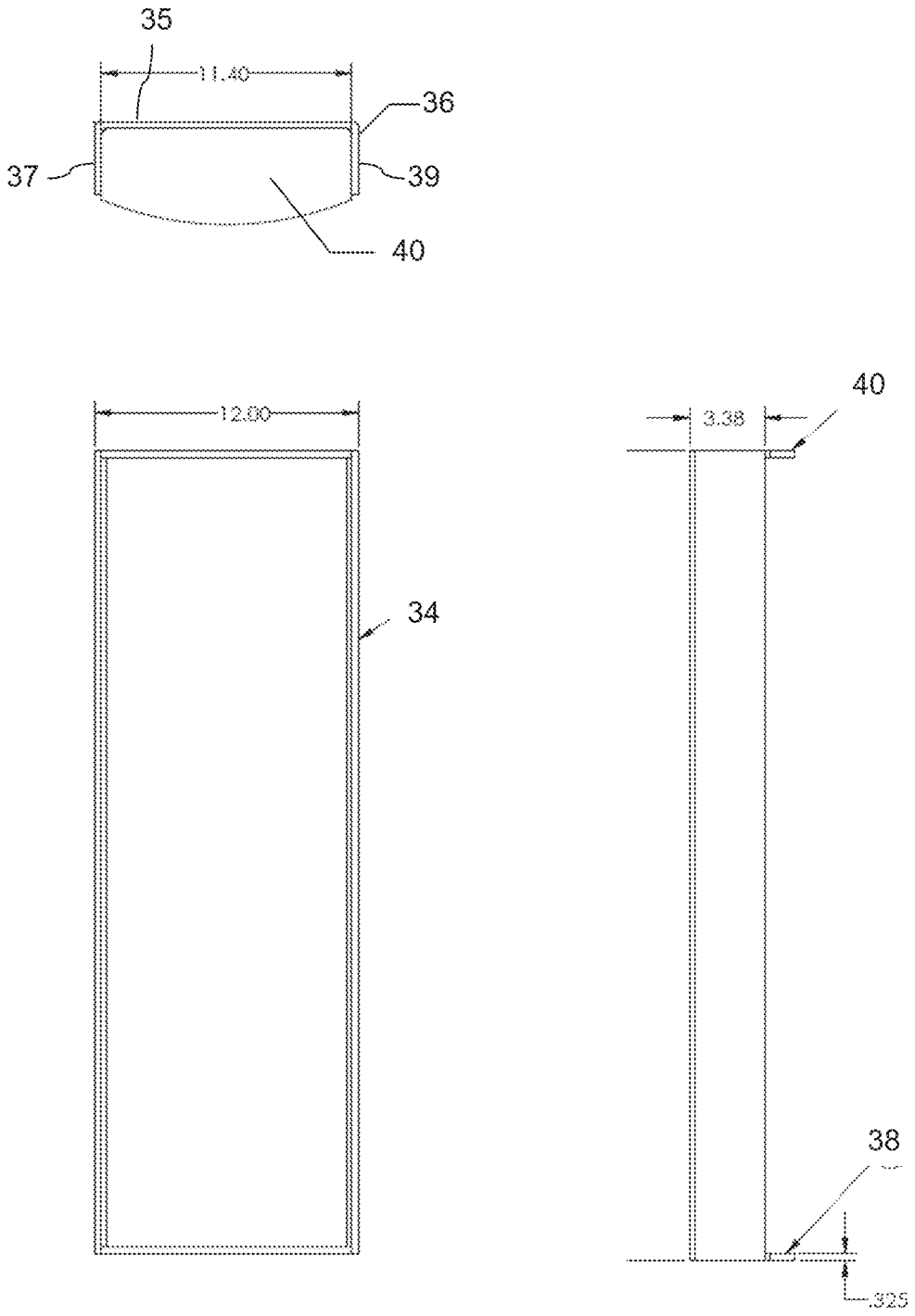
FIG. 7 are views of a longitudinal reinforcing member for stabilizing fuel basket tubes within the canister of FIG. 4.
Figure 8:
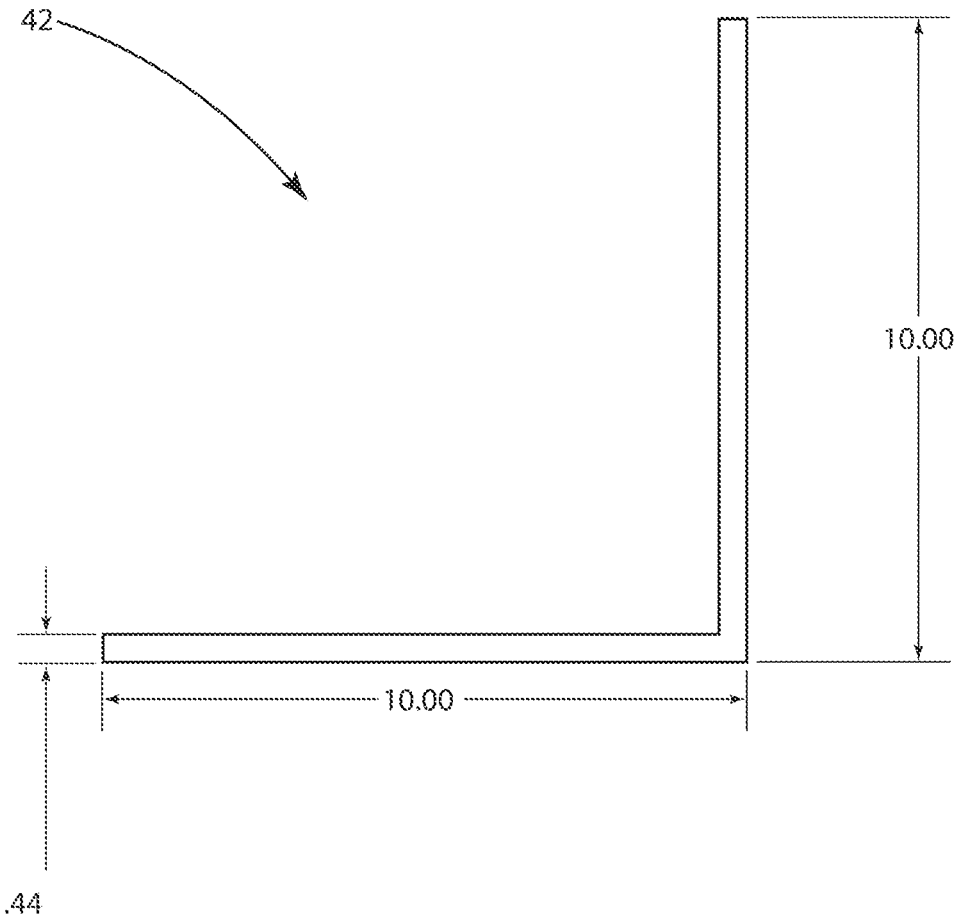
FIG. 8 is a radiation-absorbing panel in accordance with an embodiment of the invention.

As shown in FIG. 6, the canister 20 includes multiple radiation-absorbing panels 42 between adjacent fuel basket tubes 32. The radiation-absorbing panels 32 include a v-shaped or chevron-shaped cross-section in the present embodiment as shown in FIG. 8, generally extending along the length of the canister enclosure. In particular, two radiation-absorbing panels 42 are shown in FIG. 6, forming a t-shaped partition along the longitudinal center of the canister enclosure. The radiation-absorbing panels 42 can be formed of any material adapted to absorb or suppress radiation, for example neutron radiation. In the present embodiment, for example, the radiation absorbing panels 42 include borated stainless steel to suppress interaction of adjacent used fuel assemblies 30. In addition, the canister 20 includes one or more drain ports 44 for the evacuation of water from the canister enclosure. One drain port 44 is shown in FIG. 6, but any number of drain ports can be utilized as desired.

Figure 9:
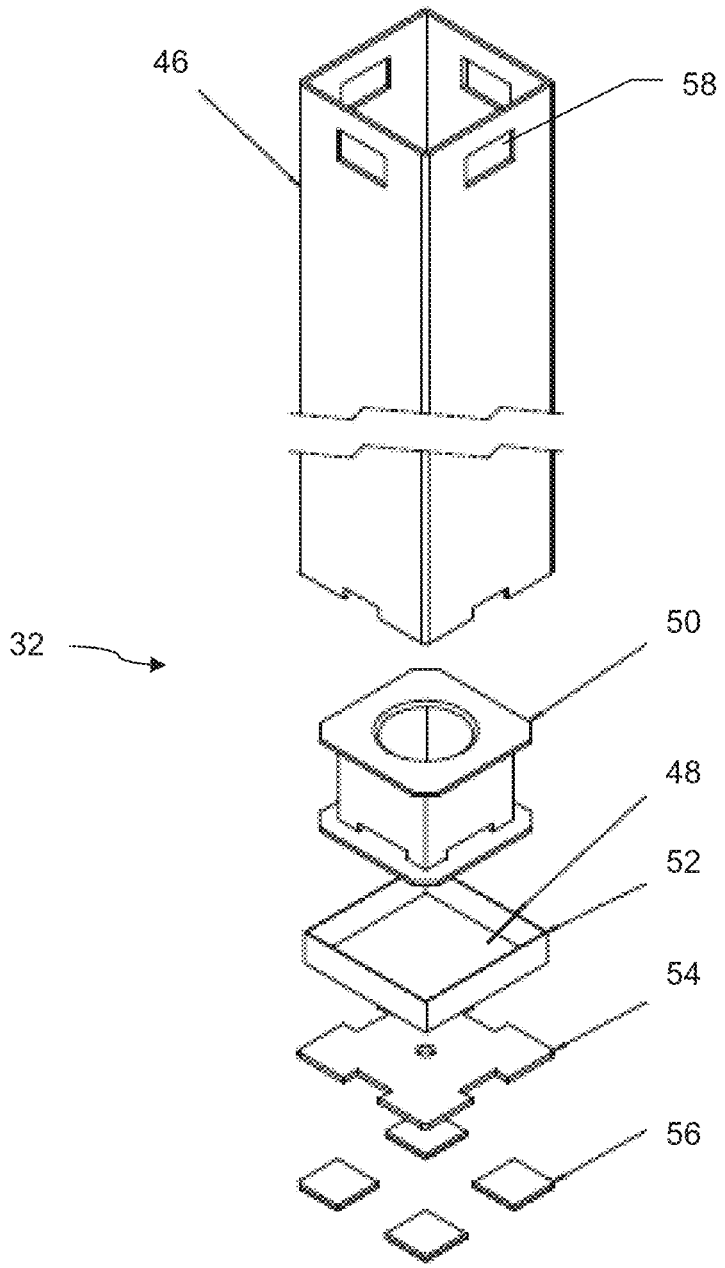
FIG. 9 is a partially exploded view of a fuel basket tube in accordance with an embodiment of the invention.

As noted above, each used fuel assembly 30 is self-contained within a fuel basket tube 32. A typical used fuel assembly 30 can include uranium rods within zircaloy tubes bundled in a rectangular configuration. As shown in FIG. 9, the fuel basket tube 32 can include a rectangular sidewall 46, optionally a stainless steel shell, including a wire mesh insert 48 at a lower portion thereof to meet existing damaged fuel requirements for containment. The fuel basket tube 32 functions as a structural support piece within the canister enclosure, and is optionally sized for deep-bore disposal within a geologic repository. Each fuel basket tube 32 can accommodate two fuel assembly's worth of fuel rods when rods are consolidated out of the assembly lattice configuration. As also shown in FIG. 9, the fuel basket tube 32 includes a chair 50 seated atop a wire mesh tray 52. The chair 50 functions as a spacer between the wire mesh tray 52 and the fuel rods. Different chairs can accommodate different fuel rods. That is, a shorter chair can accommodate longer fuel rods, while a longer chair can accommodate shorter fuel rods. The fuel basket tube 32 additionally includes a sheath bottom 54 and a sheath foot 56 at the base of the fuel basket tube 32. In addition, the fuel basket tube 32 includes a redundant retrieval mechanism for handling fuel assemblies. In the illustrated embodiment, the primary retrieval mechanism is consistent with how used fuel was originally loaded where the fuel assembly handle is hoisted by a grapple arm. The secondary retrieval mechanism includes an aperture or a recess 58 in the fuel basket tube sidewall 46, optionally each face of the sidewall 46, to receive a corresponding mating member that also caps the tube making it suitable for borehole disposal. In use, the fuel assemblies can be hoisted from the canister 20 using the primary retrieval mechanism, with added redundancy in the second retrieval mechanism 58 if the first retrieval mechanism becomes damaged or compromised.

Figure 10:
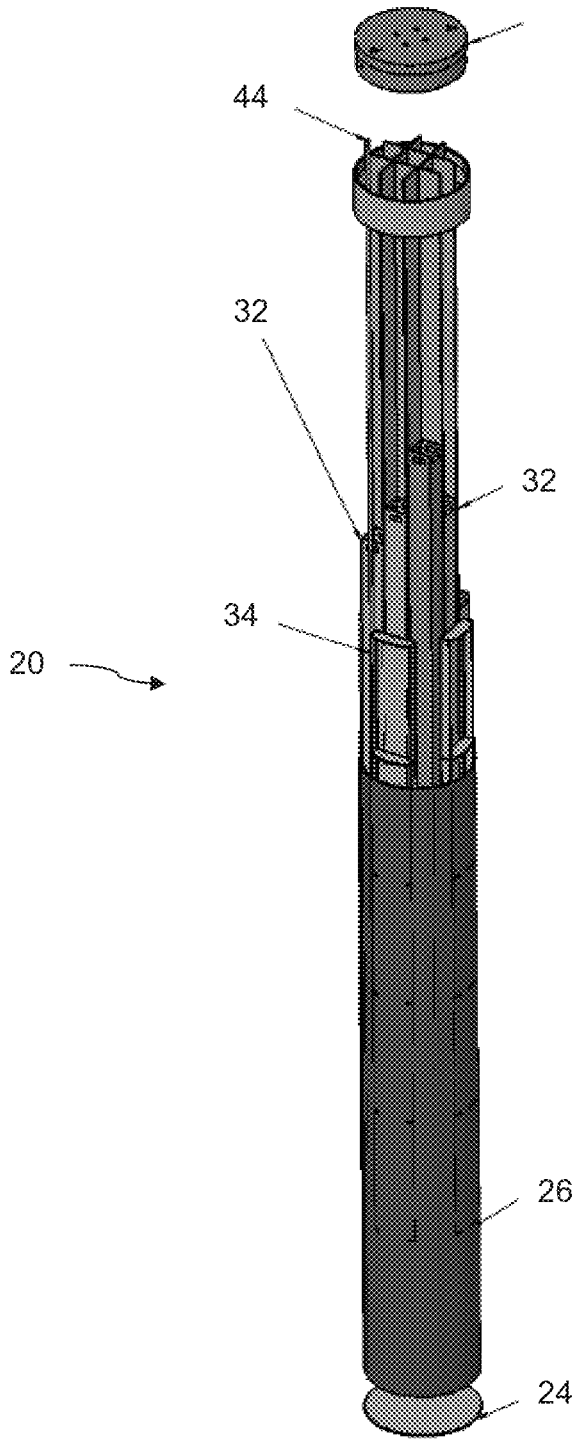
FIG. 10 is an illustration of a BWR canister in accordance with an embodiment of the invention.
Figure 11:
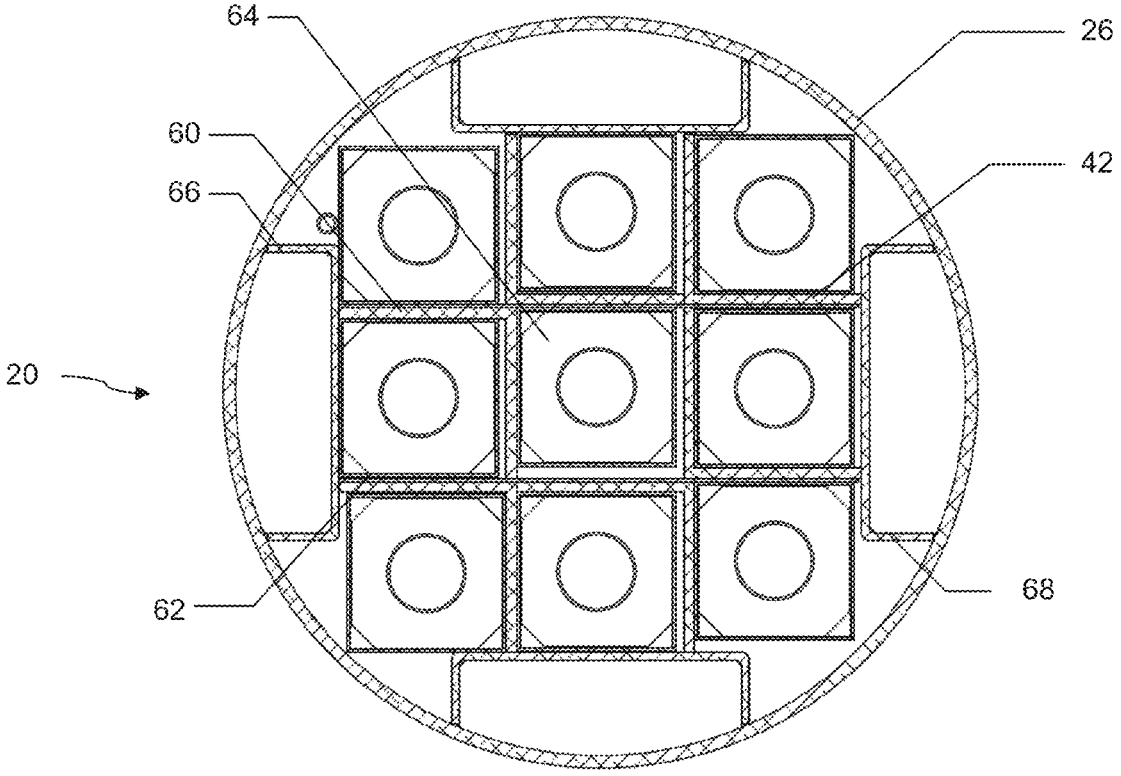
FIG. 11 is a cross-sectional top view of the canister of FIG. 10.

The system of the present invention is well suited for the storage, transportation and disposal of used fuel assemblies from Pressurized Water Reactor (PWR) systems and Boiling Water Reactor (BWR) systems. Advantageously, a single cask 10 can include canisters from both systems. The smaller BWR assemblies can be received within the same sized canister for containing PWR assemblies. For example, a nine-assembly BWR canister 20 is shown in FIGS. 10-11. The radiation-absorbing panels 42 slide between adjacent fuel basket tubes 32 as generally described above in connection with FIG. 6. Though depicted as being unitary in FIG. 10, the panels 42 are typically moveable with respect to each other, allowing the replacement of a single panel without requiring the removal of the remaining panels. In addition, spaced apart thermal shunts 60, 62 traverse the central region of the canister to facilitate heat removal from the central fuel basket tube 64 to left and right reinforcing members 66, 68, and then the cylinder sidewall 26. The thermal shunts 60, 62 can be formed from aluminum and can extend along the height of the canister 20. The number, orientation and placement of the radiation-absorbing panels 42 can vary to meet criticality requirements. In some instances, for example, the radiation-absorbing panel 42 will extend between some, but not all, of adjacent fuel basket tubes 34.

A method for processing used nuclear fuel assemblies in accordance with the above described system includes loading multiple fuel basket tubes into the modular canisters, where each fuel basket tube includes a single used fuel assembly, inserting the modular canisters into a cask for storage at a first facility, transporting the canisters to a second facility (optionally while self-contained within the cask), and removing the canisters and optionally the fuel basket tubes for disposal or reprocessing at the second facility. Loading operations can optionally take place within a cooling pool, including loading used nuclear fuel into the canister while submerged in water. A subsequent drying operation includes filling the canister with a non-reactive gas, for example helium, nitrogen, argon, neon, radon, krypton or xenon. Disposal operations include optional deep bore disposal of the fuel basket tube and/or the canister within a designated geologic repository.

The system and method of the present invention can eliminate the need for repackaging fuel assemblies, as the fuel assemblies generally remain in the containers 20 across storage, transportation and disposal operations. In addition, the system and method allow improved decay heat management of high burnup and mixed oxide fuel, and can enable an increased percentage of fuel acceptable in terms of subcriticality requirements for various modes. The system also provides a technical basis for meeting transportation requirements based on moderator exclusion. For those facilities that have not begun dry cask storage, the lighter canisters 20 provide increased options and are expected to offer more efficient drying processes over conventional systems. The present invention can also eliminate the need for Independent Spent Fuel Storage Installation (ISFSI) pads for dry cask storage by allowing in-ground storage or above-ground shielded structures. In addition, the present invention enables retrievability regardless of the fuel condition, including the handling of damaged fuel assemblies before and after transport to a disposal facility.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. A method for processing used nuclear fuel assemblies, the method comprising:

providing a plurality of fuel basket tubes each including a used nuclear fuel assembly;

providing a plurality of canisters each including a radiation-absorbing panel extending longitudinally therein, the plurality of canisters further including:

a canister sidewall defining a canister enclosure and a plurality of longitudinal reinforcing members, the plurality of longitudinal reinforcing members including:

a vertical reinforcing member sidewall including a major web and two spaced apart minor webs that define a u-shaped cross-section, and upper and lower horizontal ribs interconnecting the major web and the spaced apart minor webs at longitudinally spaced apart portions of the vertical reinforcing member sidewall to provide torsional rigidity to the longitudinal reinforcing member, wherein the upper and lower horizontal ribs extend to the canister sidewall and contact the canister sidewall to transfer heat thereto from the plurality of fuel basket tubes when the plurality of fuel basket tubes are received within the canister enclosure;

loading at least four of the plurality of the fuel basket tubes into each of the plurality of canisters, the radiation-absorbing panel being interposed between adjacent fuel basket tubes;

inserting the plurality of canisters into a cask in side by side relationship for storage and a first facility;

transporting the cask to a second facility remote from the first facility; and removing the plurality of canisters from the cask at the second facility for disposal of the used nuclear fuel assemblies.

2. The method according to claim 1 wherein each radiation-absorbing panel extends substantially the length of the corresponding canister.

3. The method according to claim 1 wherein the plurality of fuel basket tubes include a secondary assembly retrieval mechanism at an upper portion thereof.

4. The method according to claim 1 wherein each of the plurality of canisters includes a drain port for the evacuation of water from the canister interior volume.

5. The method according to claim 1 wherein the radiation absorbing panels include a v-shaped cross-section.

6. The method according to claim 1 wherein each of the plurality of fuel basket tubes includes an internal chair to support the used nuclear fuel above the mesh wire tray.

7. The method according to claim 4 wherein each of the plurality of fuel basket tubes includes a retrieval mechanism.

8. The method according to claim 7 wherein the retrieval mechanism includes a recess in a rectangular fuel basket tube sidewall.

* * * * *